US008287406B2

(12) United States Patent
Biederman et al.

(10) Patent No.: US 8,287,406 B2
(45) Date of Patent: Oct. 16, 2012

(54) GAME WITH A FLYING OBJECT

(76) Inventors: Bryan Biederman, Holderness, NH (US); John St. Amand, Moultonborough, NH (US)

( * ) Notice: Subject to any disclaimer, the term of this patent is extended or adjusted under 35 U.S.C. 154(b) by 344 days.

(21) Appl. No.: 12/575,582

(22) Filed: Oct. 8, 2009

(65) Prior Publication Data

US 2010/0120559 A1 May 13, 2010

Related U.S. Application Data

(60) Provisional application No. 61/103,985, filed on Oct. 9, 2008.

(51) Int. Cl.
*A63B 67/00* (2006.01)

(52) U.S. Cl. ..... 473/470

(58) Field of Classification Search ..... 473/415, 473/465, 469, 470, 471; 16/441; 446/124; 52/301; D21/775; D25/135; D8/386
See application file for complete search history.

(56) References Cited

U.S. PATENT DOCUMENTS

| | | | | | |
|---|---|---|---|---|---|
| 1,631,227 | A * | 6/1927 | See | 248/511 |
| 3,077,035 | A * | 2/1963 | Hackney | 33/293 |
| 3,119,588 | A * | 1/1964 | Keats | 248/158 |
| 3,328,928 | A * | 7/1967 | Frye | 52/157 |
| 3,420,013 | A * | 1/1969 | Alvarado | 52/161 |
| 3,436,090 | A * | 4/1969 | Hebron et al. | 280/821 |
| 4,204,357 | A * | 5/1980 | Harrington | 446/47 |
| 4,533,122 | A * | 8/1985 | Bannister | 256/69 |
| 4,913,428 | A * | 4/1990 | Nauman | 52/165 |
| 5,112,023 | A * | 5/1992 | Sowers | 248/519 |
| 5,139,283 | A * | 8/1992 | Dow et al. | 280/819 |
| 5,568,708 | A * | 10/1996 | Kassardjian et al. | 52/301 |
| 5,778,914 | A * | 7/1998 | Trani | 135/66 |
| 5,944,318 | A * | 8/1999 | Payton | 273/402 |
| 6,328,665 | B1 * | 12/2001 | Gormley | 473/423 |
| D460,571 | S * | 7/2002 | Schimmelpfennig | D25/135 |
| 7,104,902 | B2 * | 9/2006 | Dopson | 473/465 |
| 7,360,767 | B2 * | 4/2008 | Merccica | 273/350 |
| 2004/0169121 | A1 * | 9/2004 | Winn | 248/530 |
| 2008/0204867 | A1 * | 8/2008 | Puga et al. | 359/399 |

OTHER PUBLICATIONS

Webpage download, beersbee08,2008, http://web.archive.org/web/20080506083100/http://www.beersbee.org/, 10 pages.*
Screen shots of YouTube video, Beersbee07,2007,http://www.youtube.com/watch?v=65E9B45WJww , 4 pages.*

(Continued)

*Primary Examiner* — Gene Kim
*Assistant Examiner* — M Chambers
(74) *Attorney, Agent, or Firm* — Nutter McClennen & Fish LLP; Reza Mollaaghababa; Lauren Ingegneri

(57) ABSTRACT

Methods and devices, including kits, are disclosed herein for playing a flying disc game. For instance, some aspects are directed to kits for playing flying disc game that can include one or more poles (e.g., two), one or more target objects (e.g., two), and/or a flying disc. The pole can be insertable into a ground surface, or can optionally be inserted into a free standing base. The target object can be detachably placed on the a target support of the pole, which can be dislodged by a player throwing the flying disc at the target object. Various configurations for the poles, target objects, and flying disc are discussed. As well, a method for playing a flying disc game, (e.g., one using some assembly of the equipment disclosed) is also revealed.

19 Claims, 5 Drawing Sheets

OTHER PUBLICATIONS

Screen shots of YouTube video, Littleton,2007,http://www.youtube.com/watch?v=fAkWYZfVLWU, 2 pages.*
Screen shots of YouTube video, PolishHorseshoes,2007,www.youtube.com/watch?v=40hTKU4S3H4&feature=related, 3 pages.*
Screen shots of YouTube video, PolishHorseshoesExplained,2007,www.youtube.com/watch?v=wZGKzUgTtUY , 4 pages.*
AbsolutePunk.net—Frisbee Game, http://www.absolutepunk.net/showthread.php?t=249691 (publication date unknown).
BarMeister.com: Drinking Game: Posties, http://www.barmeister.com/qames/rules/627/ (publication date unknown).
BeerFrisbie.com: The Unofficial Site of Beer Frisbee Enthusiasts—Rules, http://www.beerfrisbee.com/rules.html (publication date unknown).
Beersbie Drinking Game aka Frisknock, Beer Frisbee, or Beersby, http://www.legendarypartyideas.com/beersbie.html (publication date unknown).
Buy Beersbee: Purchase the Frisbee Drinking Game, http://www.beersbee.org (publication date unknown).
Gameplay@Polesh.com—The Game, http://www.polesh.com/gameplay.html (publication date unknown).
History of Beersbee: A Frisbee Drinking Game, http://www.beersbee.org (publication date unknown).
How to Play French Darts, http://www.Roanoke.com/entertainment/insideout/stories/wb/xp-84564 (publication date unknown).
How to Play the Summer Drinking Game Polish Horseshoes, http://www.ehow.com/how_5238271-play-drinking-qame-polish-horeseshoes.html (publication date unknown).
International Polish Horseshoes Federation: Rules of Engagement, http://polishhorseshoes.blogspot.com/2006/09/rules-of-engagement.html (publication date unknown).
Polesh—the Revolutionary New Flying Disc Game, http://www.polesh.com/index.html (publication date unknown).
Polish Horseshoe—Wikipedia, http://en.Wikipedia.org/wiki/Polish_horseshoes (publication date unknown).
Purchase Polesh, http://www.polesh.com/purchase.html (publication date unknown).
Quazen—French Darts: A New Summer Game, http://quazen.com/games/French-darts-a-new-summer-game/ (publication date unknown).
Rules of Beersbee: A Frisbee Drinking Game, http://www.beersbee.org (publication date unknown).
The Ultimate Polesh Pole, http://www.polsh.com/thepole.html (publication date unknown).
Why Polesh?—An Inside Look at the Newest Plying Disc Pole Game, http://www.polesh.com/whypolesh.html (publication date unknown).

* cited by examiner

GAME WITH A FLYING OBJECT

CROSS REFERENCE TO RELATED APPLICATION

The present application claims the benefit of a U.S. Provisional Application Ser. No. 61/103,985, filed Oct. 9, 2008, entitled "Game with a Flying Object." The provisional application is hereby incorporated herein by reference in its entirety.

FIELD OF THE APPLICATION

The present application relates to methods and devices for playing a game, and more particularly to a game using a flying object such as a flying disc.

BACKGROUND

Games are known in the art in which a flying object is thrown at a target. Such games can be a source of entertainment, while also developing physical fitness and coordination, and also serving as a vehicle for promoting healthy competitiveness while building comradeship. As people maintain a constant curiosity and desire to play new games, the need persists for novel games, and the equipment associated with such games that facilitate their play.

SUMMARY

Some exemplary embodiments are drawn to kits for playing a flying disc game. The kit can include one or more poles. A pole can be configured to be positioned in an upright configuration (e.g., vertical). In some instances, the pole can include an interchangeable first end configured to be inserted into a ground surface and/or base that can be placed on an impermeable surface. Accordingly, the base can detachably couple with a pole or be permanently affixed with the pole. The pole can have an end having a target support. A target object (e.g., an object having a bottle-like shape) can be configured to be detachably coupled to the target support of a pole when the pole is in an upright configuration. A flying object can be optionally included. The flying object (e.g., a flying disc) can be configured to be thrown by a person, the flying object being capable of detaching the target object from the pole when the flying object strikes at least one of the pole and the target object. The flying object can weigh between about 100 grams and about 200 grams. Some kits can be assembled to include two or more poles with an equal number of corresponding target objects.

A pole can include an insertion marker configured to designate a ground insertion depth for the pole. The pole may also include a foot guide, configured to facilitate pole insertion into the ground surface (e.g., by allowing a foot to be placed on the guide to help insertion of the pole) or to mark pole insertion into a free standing base. Each pole may include an interchangeable base for the pole so that pole can free stand on any surface (e.g. asphalt). Poles can also have a height marker configured to designate a selected distance (e.g. 3 feet or less) above the ground surface when the pole is inserted into the ground surface. One or more target objects can also be included. In some instances, the target support is configured to mate with a surface of the at least one target object. For example, the target support can include a convex surface facing away from the end of the pole configured for ground insertion. Accordingly, the target object can include a surface complementary to the convex surface. In some instances, the convex surface of the target support does not extend beyond a width of the target object. Target supports can also be configured to be decoupleable from the remainder of a pole. Poles can be configured as height adjustable poles, and/or poles configured to be decoupleable into a plurality of pieces. With regard to kits or devices utilizing a base, the base can be hollow and fillable with a weighting material, and optionally include a plug for holding the material. The base can optionally be configured to accept a foot guide in some instances.

Other exemplary embodiments are drawn to methods of playing a flying object game, which can involve two or more teams. An offensive team can throw the flying object toward a pole having a target object balanced thereon, the pole being inserted into the ground and/or standing above the ground with detachable free standing base. The offensive team can be positioned at least a designated distance from the pole (e.g., based at least in part on a resting point of a previously thrown flying object). Points can be scored based upon one or more of a position of the flying object relative to the pole; whether the target object strikes the ground, and whether a defensive team catches the flying object. Points can also be scored depending upon one or more of whether the defensive team moves beyond a designated area; whether the defensive team contacts at least one of the target object and pole before the flying object contacts at least one of the target object and the pole; and whether the defensive team traps the target object. Teams can alternate turns acting as the offensive team and the defensive team, and continue play until one team has achieved at least a designated number of points.

BRIEF DESCRIPTION OF THE DRAWINGS

Aspects of the present application can be more fully understood from the following detailed description taken in conjunction with the accompanying drawings (not necessarily to scale), in which.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with any number of features of any other embodiment (s). All such modifications and variations are intended to be included within the scope of the present invention.

Figure 1:
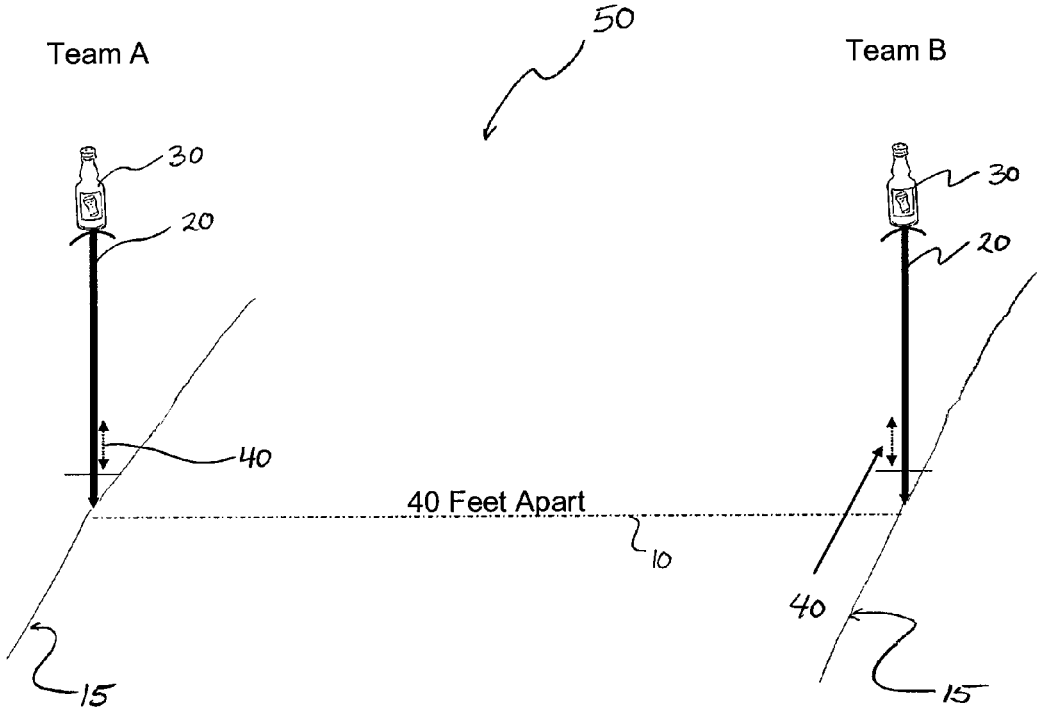
FIG. 1 is a schematic perspective diagram of a field of play for a game described herein in accord with some embodiments of the present invention.

Some embodiments of the present invention relate to methods of playing a flying object game. FIG. 1 provides an illustration of a particular configuration of equipment for playing a flying object game in accord with some embodiments. The field of play 50 can include poles 20, which can be secured to ground (e.g., inserted into the ground or base to sit on ground), and placed a designated distance apart (e.g., a distance of 40 feet apart as shown in FIG. 1) on level ground. Boundary lines 15 can be established for each pole 20, with each boundary line 15 intersecting a corresponding pole 20. In some variations, the boundary line 15 can be perpendicular to the line 10 that connects the poles 20. A target object 20 (e.g., a bottle-shaped object as shown in FIG. 1) is placed on top of each pole.

In one rendition, two teams of two players each are involved in play, though one or more players can constitute a team. Each team of two can stand next to the pole/target object pair they will defend. Teammates can assume designated sides, each standing on a side of the pole; once the game has started positions can not be changed in one variation. Each player can have a beverage or object in one hand, forcing only one hand to be used at all times during the game, though variations can be allowed for using both hands, or forcing persons to use one hand while leaving the other hand free. One team can be designated the offensive team, i.e., the team throwing the flying object, and the other team can be designated the defensive team, i.e., the team attempting to defend its target object.

Play of a version of the game can begin when a member of the offensive team tosses the flying object (e.g., a flying disc) without breaking its respective boundary line (e.g., pole), in an effort to strike the opposing team's target object or pole. The flying object can be aimed to be at least a selected distance above the ground (e.g., 12 inches) when the object strikes or passes by the pole/target object. The flying object cannot be thrown out of the reach of the defensive team (e.g., high and/or wide), i.e., the flying object should be deemed "catchable" (e.g., passing within a selected distance of the pole such as no higher than about two feet above the pole and within about five feet of the pole laterally). The defensive team, the team whose pole or target object is being thrown at, will try to catch the flying object while maintaining a position behind their own boundary line. The defensive team tries to catch the flying object only after it has crossed plane of pole/boundary line. If the flying object strikes the target object and/or the pole, causing the target object to become dismounted from the pole, the defensive team attempts to catch flying object, and the target object before the target object strikes the ground. The teams alternate turns acting as offense and defense. Players on a team can also alternate turns throwing the flying object when the team is designated for offense. If the flying object is tossed and does not travel the full distance to the defensive team's pole, the defensive team is allowed to throw the flying object from the spot the flying comes to rest when defensive team reverts to offense.

Scoring for the game can be provided for in a number of ways. For one rendition of scoring, if the flying object passes at least the selected distance above the ground, and the defensive team does not catch the flying object, one point can be awarded to the offensive team. In this rendition, the flying object must be designated "catchable" for points to be awarded to the offensive team. If the flying object passes below the selected distance above the ground and is not caught; no points are awarded to either team as long as the target object remains set on top of the pole.

If the flying object strikes the pole and/or the target object resulting in the target object hitting the ground, two points are awarded to the offensive team. These points are awarded even if the flying object flies lower than the selected distance (e.g., the flying object strikes the ground and rolls or bounces one or more times off the ground, hitting the pole and causing the target object to hit the ground). If the flying object is not caught by the defensive team along with the target object hitting the ground, three points are awarded to the offensive team. In this rendition, three points is the most points that can be awarded to the offensive team with a single throw.

To prevent the offensive team from scoring points, the defensive team tries to catch the flying object, and/or the target object before either hits the ground. If the defensive team crosses their respective boundary line, and catches the flying object in front of the pole, three points are awarded to the offensive team. If the defensive team grabs the target object or pole before flying object strikes the bottle or pole, two points are awarded to the offensive team. Defensive players cannot "trap" the target object, i.e., the target object can only be caught using the hands or flying object; other body parts cannot be used. If the bottle is trapped, the offensive team is awarded one point.

In some renditions of the game, the first team to reach twenty-one points is victorious. In some renditions, a team must win by at least two points, therefore higher scores are possible. As well, some renditions can dictate that a team can only win by having the target object strike the ground, not by a dropped flying object. For example, if the game is to be played to 21 and the current score is tied at 20, and the defensive team drops the disc, one point is not awarded to the offensive team. However, if the offensive team hits the pole with the flying object, and the target object is caught by the defensive team but the flying object is dropped, one point is awarded and the offensive team reaches 21. In any event, if the defensive team drops the target object, two points are awarded and the offensive team wins. The winning score does not have to be exactly 21; the winning score can, for example be higher than 21.

Many variations of the game's rules can be implemented within the scope of the present invention. For example, more than two teams can be involved, where only two teams can be on the field of play at one. When a team is designated the winner, the winning team stays on the playing field for next opponents, and has the ability to pick which side they would like to play on. Winners can also have the ability, if they would like, to throw the flying object first to start the game. Other variations include using various types of flying objects (e.g., balls, flying discs, other projectiles, etc.); varying the distances between the poles, the types of target objects utilized, the types and configurations of the poles, the number of points designated for various actions, the total score to be played to. Such variations can adjust the difficulty of the game depending upon the skill level/age of the players. In some instances, the game can be played with any combination of the specific kits, poles, bases for all surfaces, flying objects, and target objects disclosed in the present application. As well, one or more additional rules can be added or omitted relative to the renditions discussed herein. Any combination of these variations can be utilized in an embodiment of the invention.

Some embodiments of the present invention are drawn to devices used to play a game consistent with portions of the disclosure provided in the present application. These embodiments can include any combination of poles, stability bases, target objects, flying objects, and other devices disclosed in the present application. For example, some embodiments are drawn to kits for playing a flying disc game as disclosed in the present application. In some particular embodiments, the kit can include a pole having one end for insertion into the ground and/or a free standing base for all surfaces, and an opposite end including a target support. The kit can also include a target object configured to be detachably coupled to the target support such that the pole can support the target object when the pole is inserted in an upright position in the ground or stability base. A flying object such as a flying disc can be included in the kit. The flying object can be configured to be thrown by a person such that the target object can be dismounted from the pole when the flying object strikes the target object, the pole, or both. Kits can include a plurality of poles, pole bases, target objects, and/or flying objects. The specific configurations of the poles, pole bases, target objects, and/or flying objects can include any of the features described herein for the various devices. Accordingly, kits are not to be limited to any specific configuration or combination of devices.

Figure 2:
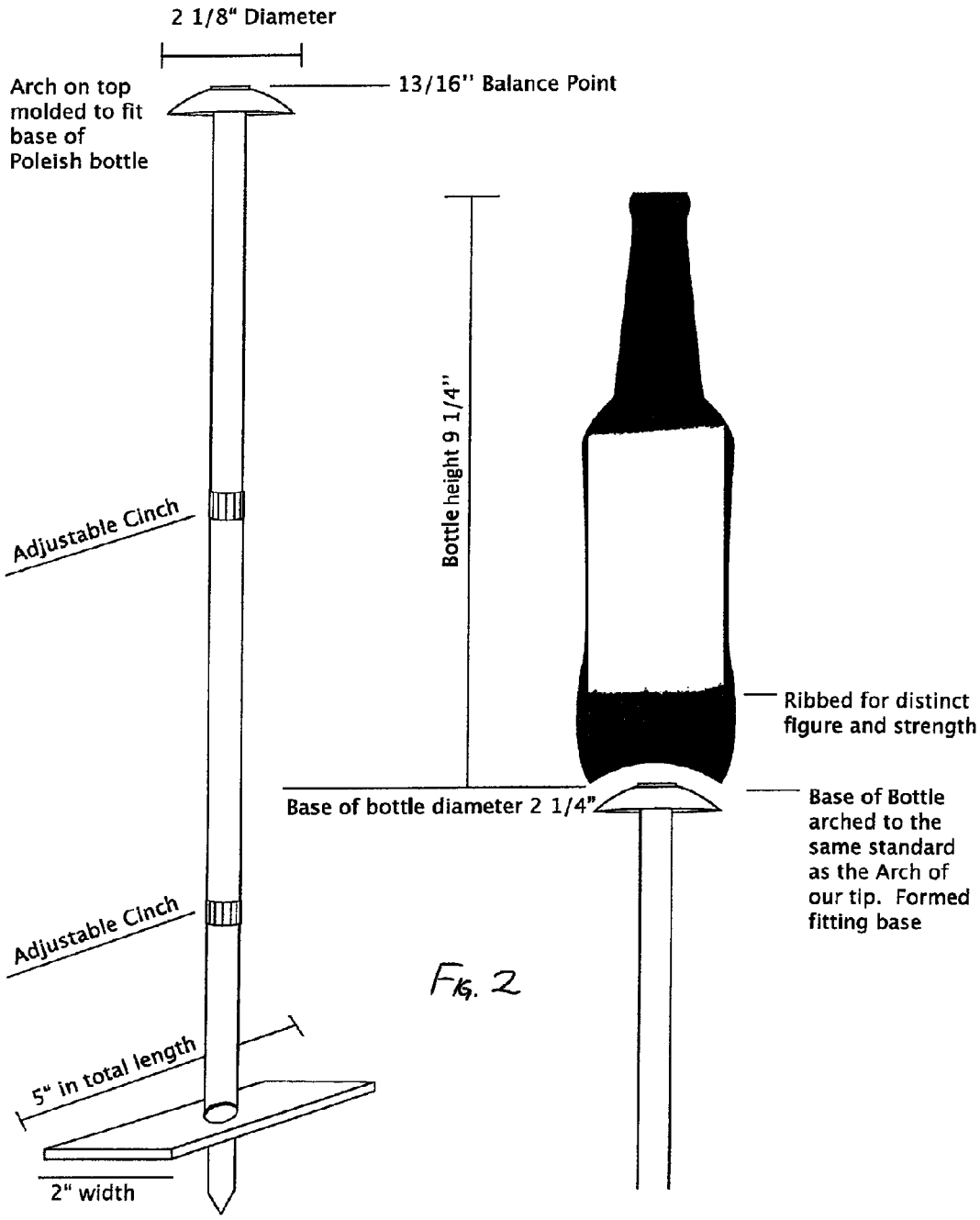
FIG. 2 is a schematic perspective view of a target object and pole that can be used to play a game consistent with some embodiments of the present invention.

Poles for use with a game consistent with the present description can be configured with a variety of variations. In some instances, the pole can be include a height adjustable pole, which can be beneficial for allowing persons of different ages to adjust the length of the pole for their use or detachable interchangeable poles. For example, as shown in FIG. 2, the pole can have one or more adjustable height adjustment mechanisms, allowing the pole to be telescopic (e.g., telescoping from a collapsed length of about 24 inches to an extended length of say 5 feet). Such a feature can also allow the pole to be collapsed to a smaller size for easy storage and/or transport. Alternatively, the pole can be decoupleable into two or more pieces.

Figure 4:
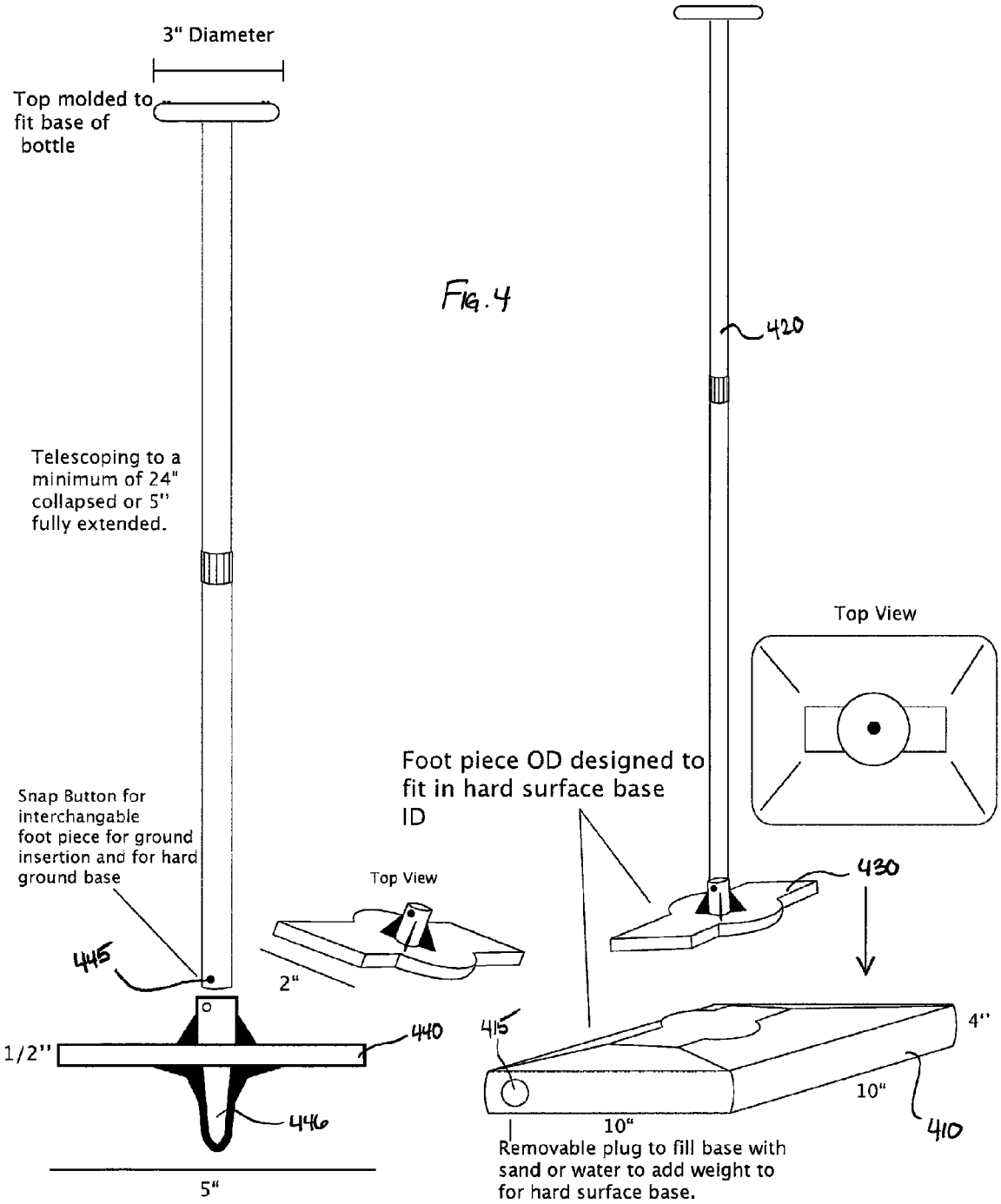
FIG. 4 provides schematic views of a pole, a foot guide, and a base consistent with some embodiments of the present invention.

As discussed, a pole can be optionally inserted into a base to maintain the pole in an upright configuration, which can allow the use of the pole on surfaces that are difficult to penetrate (e.g., asphalt). FIG. 4 provides one exemplary view of a base 410, which can accept a pole 420, and optionally coupled to a foot guide 430.

Figure 3:
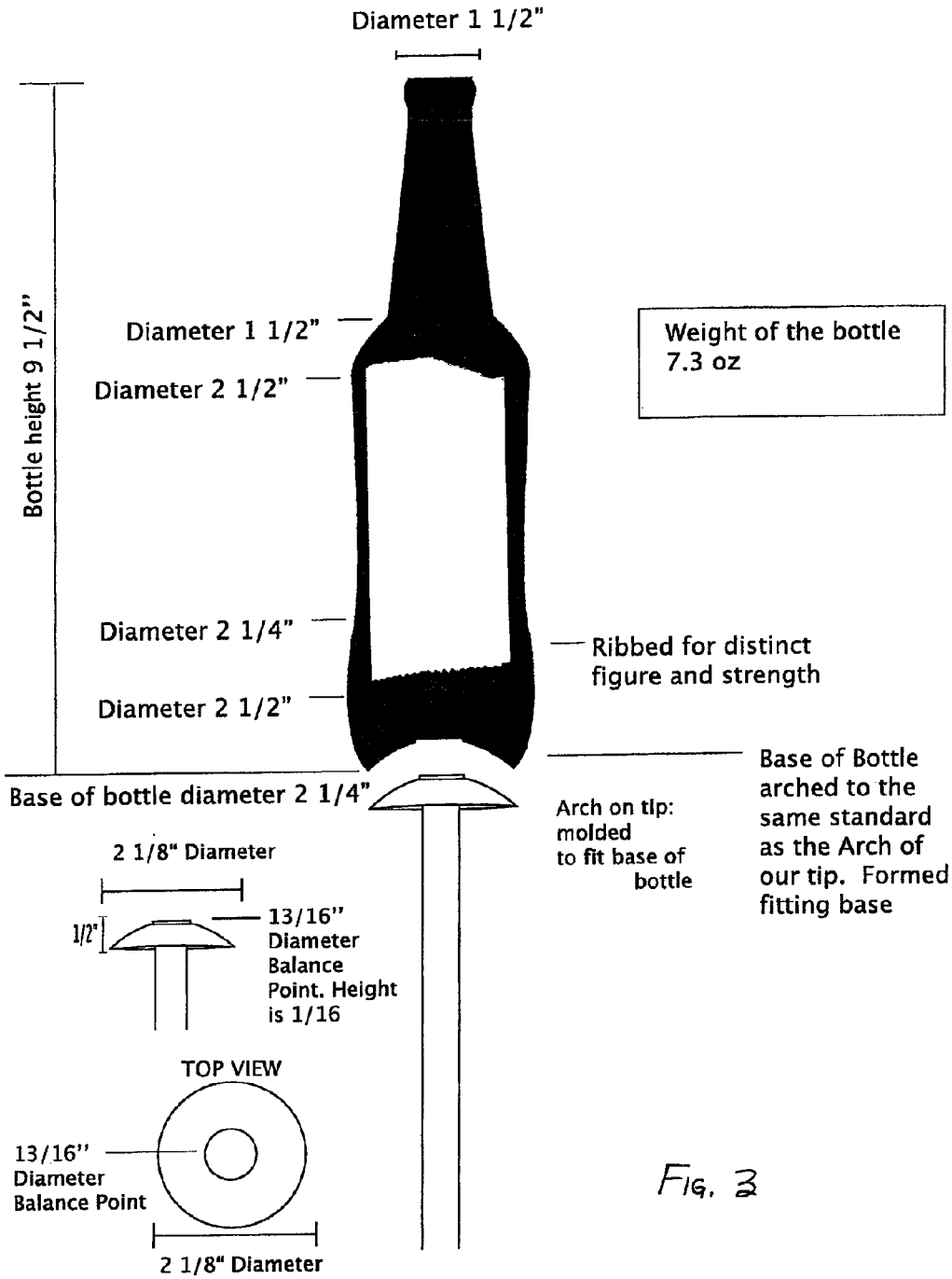
FIG. 3 presents some further views of the target object and the target support of the pole shown in FIG. 2.
Figure 5:
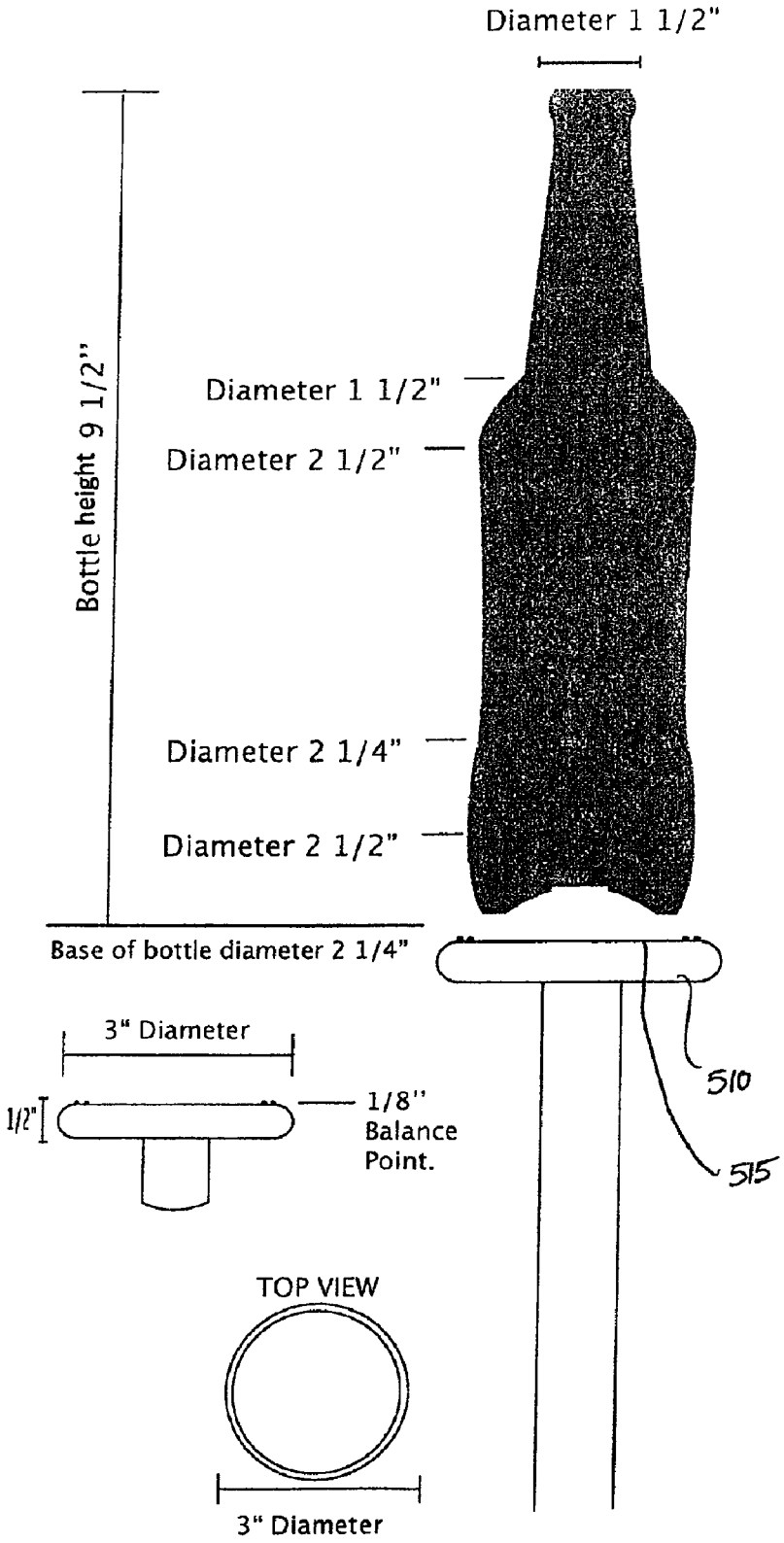
FIG. 5 provides a schematic perspective view of a target object and pole that can be used to play a game consistent with some other embodiments of the present invention.

The target support of a pole can be configured in a variety of manners for detachable coupling with a target object. In some embodiments, the target support can be configured to mate with a surface of a target object (e.g., the mating surfaces can interlock). One particular configuration is exemplified in FIGS. 2, 3, and 4. The support surface can have a variety of surfaces, which can be oriented facing away from the ground insertion end of the pole. The target object, e.g., the bottle-shaped object in FIGS. 2 and 3, can include a complementary surface to the convex surface of the target support. For example, the base of the bottle can be arched to the same standard as the arch on the tip. As well, the contacting surface of the target support can extend laterally further than the width of the target object. Such can act to enhance decoupling of the target object from the pole when the pole is struck by the flying object. Other embodiments, for example as shown in FIGS. 4 and 5, can utilize a flat surface 515 on a target support 510. The surface 515 can have raised ridges, also referred to as a balance point, to hold the bottle in place. The surface 515 can also have a raised logo (not shown) on the inner circle defined by the ridges to hold the bottle in place. Some embodiments can configure the target support to be attachably decoupled from the remainder of the pole (e.g., using a screw fitting or other coupling).

Poles can also include a height marker located at a designated location on the pole. The height marker can act to demark a selected distance above the ground when the pole is inserted a selected depth into the ground or free standing base. The selected distance can correspond with a minimum height that a flying object can pass by the pole, allowing points to be awarded, consistent with some embodiments disclosed herein. The minimum distance can be any suitable distance (e.g., 1, 1.5, 2, 2.5, or 3 feet). The height marker can be embodied as any suitable marking on the pole. Poles can also include an insertion marker, which can be used to indicate the depth to which a pole should be inserted into the ground. Insertion markers can also be embodied as any suitable marking on the pole. In another embodiment, a pole can include a foot guide to aid insertion of the pole into the ground; such can also act to enhance the durability and stability of the pole. An exemplary embodiment of a foot guide is shown in FIG. 2. In some instances, the insertion marker and the foot guide can be the same element. Other features of a foot guide are shown in FIG. 4. For instance, the foot guide 440 can include a snap button 445 or other fixture to maintaining the position of the foot guide 440 at a particular position. As well, the foot guide 440 can include an extension 446 which can be inserted into a ground surface and/or to mate with a base 410.

In another embodiment a pole can include a free standing base to hold a pole on all surfaces to enhance the durability and stability of the pole. Exemplary features of a base 410 are shown in FIG. 4. For instance, the base 410 can include a void space that can be filled with a weighting material (e.g., water or sand). A removable plug 415 can be included to aid the maintaining of the weight material in the base. The base 410 can also be configured to accept the foot guide 430 to aid stability of the pole 420. In other instances, though, the pole can simply be free standing in the base without contact of a foot guide with a base, or even without the presence of a foot guide whatsoever.

Any suitable design can be used for a target structure. In some embodiments, the target structure can be shaped like a bottle, as exemplified in FIGS. 2, 3, and 4. For example, the bottle can be made from a material that is non breakable, and not easily dented and/or cracked, for instance, a plastic bottle (e.g., HDPE/Rubber), which can be more durable and safer than glass. The bottle can be configured to have a size of 9½ inches in height, base of bottle 2¼ inches with a weight of 175 grams. In other embodiments, the bottle can have a weight of between about 100 grams and about 220 grams and a configuration as shown in FIG. 4. The bottle can have a wall thickness for distinct figure and strength. The bottle can be shaped to be easily grippable by a hand, and/or can include a shaped surface for mating with the target support of the pole. In some instances, the target object is designed and/or colored to enhance its visibility, which can facilitate game play.

A variety of flying objects can be utilized with the kits, devices, and methods of the present application. In many embodiments, the flying object can be embodied as a flying disc. Though the disc can have a variety of sizes, in some embodiments the disc weighs between about 100 grams and about 200 grams. For example the flying disc can weigh more than about 150 grams to enhance stability while the disc is being thrown.

EQUIVALENTS

One skilled in the art will appreciate further features and advantages of the invention based on the described and/or illustrated embodiments. Accordingly, the invention is not to be limited by what has been particularly shown and described, except as indicated by the appended claims.

All publications and references are herein expressly incorporated by reference in their entirety. The terms "a" and "an" can be used interchangeably, and are equivalent to the phrase "one or more" as utilized in the present application. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention. No language in the specification should be construed as indicating any non-claimed element as essential to the practice of the invention.

What is claimed is:

1. A kit for playing a flying disc game, comprising:

at least one pole including a first end having a target support and a second end having a foot guide configured to facilitate pole insertion into a ground surface;

at least one target object configured to detachably interlock with the target support of the at least one pole; and a flying disc configured to be thrown by a person for detaching the at least one target object from the target support of the at least one pole when the flying disc strikes at least one of the at least one pole and the at least one target object;

wherein the target support comprises a horizontal surface facing away from the first end of the pole and having at least one ridge to facilitate interlocking the target object to the target support; and wherein said foot guide is configured for detachable coupling to the second end of the pole.

2. The kit of claim 1, wherein the at least one pole comprises a height marker configured to designate a selected distance above a ground surface.

3. The kit of claim 1, wherein the at least one pole comprises an insertion marker configured to designate an insertion depth for the at least one pole.

4. The kit of claim 2, wherein the selected distance is less than 3 feet.

5. The kit of claim 1, wherein the at least one ridge has a substantially circular shape.

6. The kit of claim 1, wherein the at least one pole comprises a height adjustable pole.

7. The kit of claim 1, wherein the at least one pole comprises a pole configured to be decoupled into a plurality of pieces.

8. The kit of claim 1, wherein the at least one target object comprises a bottle shaped object.

9. The kit of claim 1, wherein the flying disc has a weight in a range between about 100 grams and about 200 grams.

10. The kit of claim 1, wherein the at least one pole comprises a plurality of poles, and the at least one target object comprises a plurality of target objects equal in number to the plurality of poles.

11. The kit of claim 1, wherein the target support is decoupleable from at least a portion of the at least one pole.

12. The kit of claim 1, wherein the at least one target object is formed from a non-breakable, dent-resistant material.

13. The kit of claim 1, wherein said pole comprises a snap button at said second end for detachable coupling to said foot guide.

14. The kit of claim 1, wherein said at least one pole is configured to be positioned in an upright configuration.

15. A kit for playing a flying disc game, comprising:

at least one pole including a first end having a target support;

at least one target object having a mating surface configured to detachably interlock with a surface of the target support of the at least one pole, the surface of the target support being horizontal and having at least one ridge to facilitate interlocking the target object to the target support;

a flying disc configured to be thrown by a person for detaching the at least one target object from the at least one pole when the flying disc strikes at least one of the at least one pole and the at least one target object; and at least one base configured to accept an end of the at least one pole.

16. The kit of claim 15, wherein the at least one base is hollow and fillable with a weighting material.

17. The kit of claim 15, wherein the at least one base is configured to accept a foot guide structure that can be coupled to the at least one pole.

18. The kit of claim 15, wherein the at least one target object is formed from a non-breakable, dent-resistant material.

19. The kit of claim 15, wherein said at least one pole is configured to be positioned in an upright configuration.

* * * * *